US011798461B2

(12) United States Patent
Wang et al.

(10) Patent No.: US 11,798,461 B2
(45) Date of Patent: Oct. 24, 2023

(54) PIXEL CIRCUIT AND DRIVING METHOD THEREOF

(71) Applicant: Wuhan China Star Optoelectronics Semiconductor Display Technology Co., Ltd., Hubei (CN)

(72) Inventors: Xuanyun Wang, Hubei (CN); Chao Dai, Hubei (CN)

(73) Assignee: Wuhan China Star Optoelectronics Semiconductor Display Technology Co., Ltd., Wuhan (CN)

( * ) Notice: Subject to any disclaimer, the term of this patent is extended or adjusted under 35 U.S.C. 154(b) by 163 days.

(21) Appl. No.: 17/266,652

(22) PCT Filed: Oct. 27, 2020

(86) PCT No.: PCT/CN2020/123980
§ 371 (c)(1),
(2) Date: Feb. 8, 2021

(87) PCT Pub. No.: WO2022/016722
PCT Pub. Date: Jan. 27, 2022

(65) Prior Publication Data

US 2022/0301488 A1 Sep. 22, 2022

(30) Foreign Application Priority Data

Jul. 24, 2020 (CN) ..... 202010725924.3

(51) Int. Cl.
*G09G 3/32* (2016.01)

(52) U.S. Cl.
CPC ..... *G09G 3/32* (2013.01); *G09G 2300/0842* (2013.01); *G09G 2310/061* (2013.01); *G09G 2320/0238* (2013.01); *G09G 2330/028* (2013.01)

(58) Field of Classification Search
CPC ..... G09G 3/32–3291; G09G 2300/0421–043; G09G 2300/0809; G09G 2300/0819; G09G 2300/0842; G09G 2300/0861; G09G 2310/0243; G09G 2310/0251; G09G 2310/06; G09G 2310/061; G09G 2310/08;
(Continued)

(56) References Cited

U.S. PATENT DOCUMENTS

2010/0039458 A1* 2/2010 Nathan ..... H05B 45/60 345/698
2020/0234651 A1* 7/2020 Liu ..... G09G 3/3275
2021/0012712 A1* 1/2021 Lin ..... G09G 3/3291

FOREIGN PATENT DOCUMENTS

CN 102222465 10/2011
CN 204680360 9/2015
CN 205722744 11/2016
(Continued)

*Primary Examiner* — Nathan Danielsen

(57) ABSTRACT

The application discloses a pixel circuit and a driving method thereof. By synchronously resetting a potential of an input end of a light-emitting unit and a potential of a control end of a driving unit, the input end of the light-emitting unit can obtain a longer reset time; when the light-emitting unit emits light, a resetting transistor and an initialization transistor are both in an off state, which can better prevent leakage of the input end of the light-emitting unit, thereby improving display effect of the pixel circuit in a dark state or low gray level.

14 Claims, 6 Drawing Sheets

(58) Field of Classification Search
CPC .... G09G 2320/0233–0242; G09G 2320/0252;
G09G 2320/028
See application file for complete search history.

(56) References Cited

FOREIGN PATENT DOCUMENTS

| | | |
|---|---|---|
| CN | 108288457 | 7/2018 |
| CN | 110610900 | 12/2019 |
| CN | 111754921 | 10/2020 |
| WO | WO 2019/112683 | 6/2019 |

* cited by examiner

PIXEL CIRCUIT AND DRIVING METHOD THEREOF

RELATED APPLICATIONS

This application is a National Phase of PCT Patent Application No. PCT/CN2020/123980 having International filing date of Oct. 27, 2020, which claims the benefit of priority of Chinese Patent Application No. 202010725924.3 filed on Jul. 24, 2020. The contents of the above applications are all incorporated by reference as if fully set forth herein in their entirety.

FIELD AND BACKGROUND OF THE INVENTION

The present application relates to the field of display technology, in particular to the field of pixel driving technology, and specifically to a pixel circuit and a driving method thereof.

With development of multimedia, display devices have become more and more important. Correspondingly, requirements for various types of display devices are getting higher and higher, especially in the field of smart phones. Ultra-high frequency drive display, low power consumption drive display, and low frequency drive display are all current and future development needs.

However, in a conventional technical solution of a pixel circuit, an anode of a light emitting diode has a leakage current and a reset time is too short, which seriously affects a dark state or low grayscale display effect of the pixel circuit.

SUMMARY OF THE INVENTION

The present application provides a pixel circuit and a driving method thereof, which solves the problem of poor display effect of the pixel circuit in a dark state or low gray scale.

In a first aspect, the present application provides a pixel circuit, comprising: a light-emitting device serially connected in a light-emitting loop between a first power signal and a second power signal; a driving transistor serially connected in the light-emitting loop, and configured to control a current flowing through the light-emitting loop; a resetting transistor, wherein one of a drain or a source of the resetting transistor is connected to an initial voltage signal, and another one of the drain or the source of the resetting transistor is connected to an anode of the light-emitting device; and an initialization transistor, wherein one of a drain or a source of the initialization transistor is connected to a gate of the driving transistor, and another one of the drain or the source of the initialization transistor is connected to the anode of the light-emitting device; wherein the resetting transistor and the initialization transistor are connected in series between the initial voltage signal and the gate of the driving transistor.

Based on the first aspect, in a first implementation manner of the first aspect, further comprising: a first light-emitting control transistor, wherein one of a drain or a source of the first light-emitting control transistor is connected to the first power signal, and another one of the drain or the source of the first light-emitting control transistor is connected to one of a drain or a source of the driving transistor; and a second light-emitting control transistor, wherein one of a drain or a source of the second light-emitting control transistor is connected to another one of the drain or the source of the driving transistor, and another one of a drain or a source of the second light-emitting control transistor is connected to the anode of the light-emitting device.

Based on the first implementation manner of the first aspect, in a second implementation manner of the first aspect, wherein a gate of the initialization transistor is connected to a first control signal, a gate of the resetting transistor is connected to a second control signal, the resetting transistor is configured to synchronously reset a potential of the anode of the light-emitting device and a potential of the gate of the driving transistor to a potential of the initial voltage signal according to the second control signal, a gate of the first light-emitting control transistor is connected to a third control signal, a gate of the second light-emitting control transistor is connected to the third control signal, and the second control signal is equal to either the first control signal or the third control signal.

Based on the second implementation manner of the first aspect, in a third implementation manner of the first aspect, comprising: a writing transistor, wherein one of a drain or a source of the writing transistor is connected to a data signal, another one of the drain or the source of the writing transistor is connected to one of the drain or the source of the driving transistor, and a gate of the writing transistor is connected to a fourth control signal.

Based on the third implementation manner of the first aspect, in a fourth implementation manner of the first aspect, comprising: a clamping transistor, wherein one of a drain or a source of the clamping transistor is connected to the gate of the driving transistor, another one of the drain or the source of the clamping transistor is connected to one of the drain or the source of the driving transistor, and a gate of the clamping transistor is connected to the fourth control signal.

Based on the fourth implementation manner of the first aspect, in a fifth implementation manner of the first aspect, comprising: a storage capacitor, wherein a first end of the storage capacitor is connected to the first power signal, and a second end of the storage capacitor is connected to the gate of the driving transistor.

Based on the fifth implementation manner of the first aspect, in a sixth implementation manner of the first aspect, wherein a channel type of the resetting transistor is different from a channel type of the first light-emitting control transistor and a channel type of the second light-emitting control transistor; and wherein the resetting transistor is an oxide transistor, and the first light-emitting control transistor and the second light-emitting control transistor are both silicon transistors.

Based on the sixth implementation manner of the first aspect, in a seventh implementation manner of the first aspect, wherein the channel type of the resetting transistor and a channel type of the initialization transistor are same; and wherein the initialization transistor is an oxide transistor.

Based on any of the foregoing implementation manners of the first aspect, in an eighth implementation manner of the first aspect, wherein a potential of the first power signal is greater than a potential of the second power signal.

In a second aspect, the present application provides a pixel circuit, comprising: a light-emitting unit serially connected in a light-emitting loop between a first power signal and a second power signal; a driving unit serially connected in the light-emitting loop, and is configured to control a current flowing through the light-emitting loop; an initialization unit, wherein an input end of the initialization unit is connected to an input end of the light-emitting unit, an output end of the initialization unit is connected to a control end of the driving unit, and the initialization unit is configured to initialize a potential of the control end of the driving unit according to a first control signal; and a resetting unit connected to the input end of the light-emitting unit and configured to control a potential of the input end of the light-emitting unit and the potential of the control end of the driving unit to synchronously reset to a potential of an initial voltage signal according to a second control signal.

Based on the second aspect, in a first implementation manner of the second aspect, further comprising: a light-emitting control unit serially connected in the light-emitting loop, wherein an output end of the light-emitting control unit is connected to the input end of the light-emitting unit, and the light-emitting control unit is configured to control the light-emitting loop on and off according to a third control signal.

Based on the first implementation manner of the second aspect, in a second implementation manner of the second aspect, wherein the second control signal is equal to either the first control signal or the third control signal.

Based on the second implementation manner of the second aspect, in a third implementation manner of the second aspect, further comprising: a writing unit coupled to an input end or an output end of the driving unit and configured to write a data signal to the pixel circuit according to a fourth control signal.

Based on the third implementation manner of the second aspect, in a fourth implementation manner of the second aspect, further comprising: a clamping unit, wherein an output end of the clamping unit is connected to the control end of the driving unit, an input end of the clamping unit is connected to the input end of the driving unit or the output end of the driving unit, and the clamping unit is configured to clamp the potential of the control end of the driving unit to a potential of the input end of the driving unit or a potential of the output end of the driving unit according to the fourth control signal.

Based on the fourth implementation manner of the second aspect, in a fifth implementation manner of the second aspect, further comprising: a storage unit, wherein a first end of the storage unit is connected to the first power signal, a second end of the storage unit is connected to the control end of the driving unit, and the storage unit is configured to store the potential of the control end of the driving unit.

In a third aspect, the present application provides a driving method of a pixel circuit, comprising following steps: controlling an initial voltage signal to synchronously initialize a potential of an input end of a light-emitting unit and a potential of a control end of a driving unit by a first control signal and a second control signal; controlling a data signal to be written to an input end of the driving unit or an output end of the driving unit by a fourth control signal, and clamping a potential of the control end of the driving unit to a potential of the input end of the driving unit or a potential of the output end of the driving unit by the fourth control signal; and driving the light-emitting unit to emit light with a voltage difference between a first power signal and a second power signal by a third control signal.

In the pixel circuit and the driving method thereof provided in the present application, by synchronously resetting the potential of the input end of the light-emitting unit and the potential of the control end of the driving unit, the input end of the light-emitting unit can obtain a longer reset time; when the light-emitting unit emits light, the resetting transistor and the initialization transistors are all in the off state, which can better prevent the leakage of the input end of the light-emitting unit, thereby improving the display effect of the pixel circuit in the dark state or low gray level.

DESCRIPTION OF SPECIFIC EMBODIMENTS OF THE INVENTION

Figure 1:
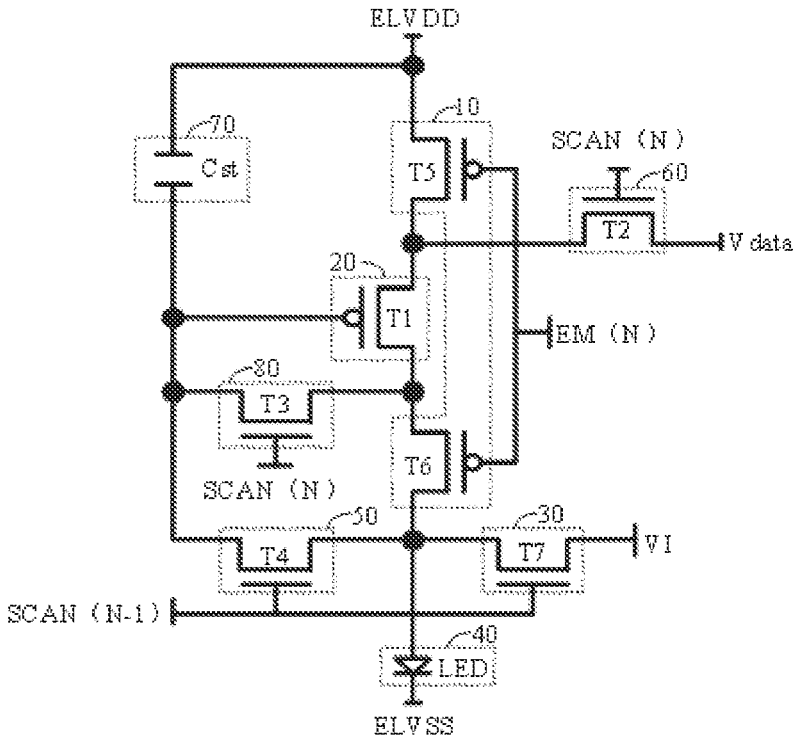
FIG. 1 is a schematic diagram of a first structure of a pixel circuit provided by an embodiment of the application.
Figure 2:
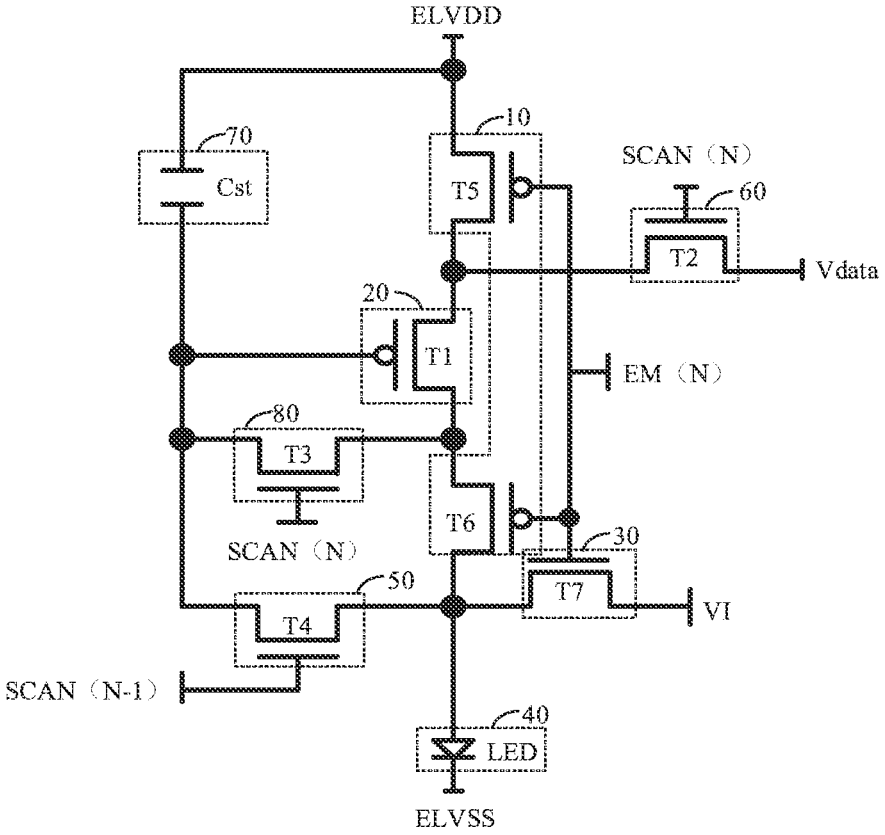
FIG. 2 is a schematic diagram of a second structure of the pixel circuit provided by an embodiment of the application.
Figure 3:
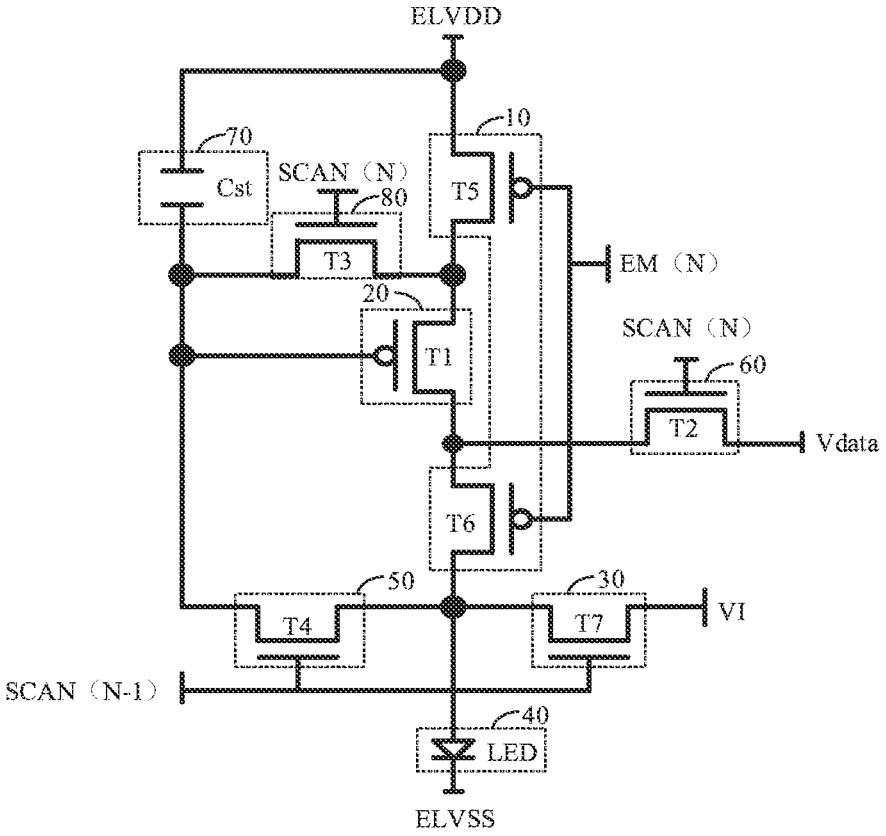
FIG. 3 is a schematic diagram of a third structure of the pixel circuit provided by an embodiment of the application.
Figure 4:
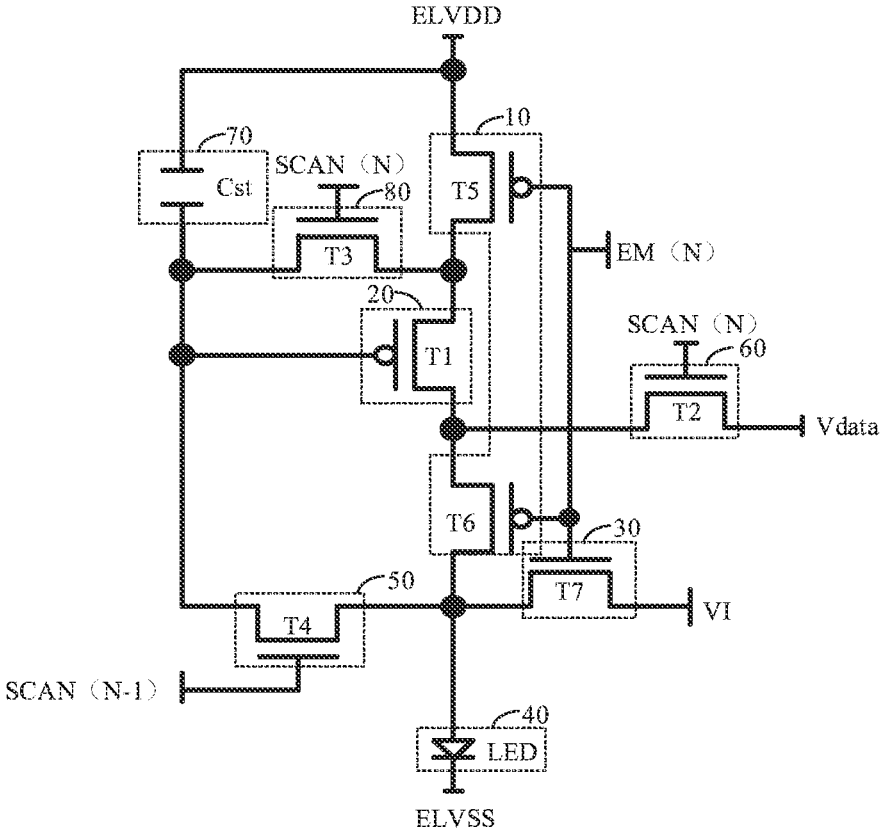
FIG. 4 is a schematic diagram of a fourth structure of the pixel circuit provided by an embodiment of the application.

In order to make the purpose, technical solutions and effects of this application clearer and clearer, the following further describes this application in detail with reference to the drawings and embodiments. It should be understood that the specific embodiments described herein are only used to explain the application, and not used to limit the application.

As shown in FIGS. 1 to 4, an embodiment provides a pixel circuit, comprising a light-emitting unit 40, a light-emitting control unit 10, and a resetting unit 30; the light-emitting unit 40 serially connected in a light-emitting loop between a first power signal ELVDD and a second power signal ELVSS; the light-emitting control unit 10 serially connected in the light-emitting loop, wherein an output end of the light-emitting control unit 10 is connected to the input end of the light-emitting unit 40, and the light-emitting control unit 10 is configured to control the light-emitting loop on and off according to a light-emitting control signal EM(N); and the resetting unit 30 connected to the input end of the light-emitting unit 40 and configured to control a potential of the input end of the light-emitting unit 40 to synchronously reset to a potential of an initial voltage signal VI according to a first scan signal SCAN (N-1) or the light-emitting control signal EM(N). The input end of the light-emitting unit 40 is controlled to reset by the light-emitting control signal EM (N) or the first scan signal SCAN (N-1), which can obtain a longer reset time. At the same time, when the light-emitting unit 40 emits light, a resetting transistor T7 and an initialization transistor T4 are both in the off state, which can better prevent the leakage of the input end of the light-emitting unit 40, thereby improving the display effect of the pixel circuit in the dark state or low gray level.

Wherein, the light-emitting control unit 10 comprises a first light-emitting control transistor T5 and a second light-emitting control transistor T6. An input end of the first light-emitting control transistor T5 is connected to the first power signal ELVDD, and a control end of the first light-emitting control transistor T5 is connected to the light-emitting control signal EM (N); an input end of the second light-emitting control transistor T6 is connected to an output end of a driving transistor T1, and a control end of the second light-emitting control transistor T6 is connected to the light-emitting control signal EM (N).

It can be understood that the first light-emitting control transistor T5 and the second light-emitting control transistor T6 are in an off state or a saturated state at the same time, so as to simultaneously control the on and off of the light-emitting loop. Wherein, the light-emitting control signal EM (N) can be, but is not limited to, an Nth level light-emitting control signal.

Wherein, the resetting unit 30 comprises a resetting transistor T7, an input end of the resetting transistor T7 is connected to the initial voltage signal VI, an output end of the resetting transistor T7 is connected to the output end of the second light-emitting control transistor T6, and a control end of the resetting transistor T7 is connected to the first scan signal SCAN (N-1) or the light-emitting control signal EM (N).

It should be noted that the light-emitting control signal EM (N) controls the resetting transistor T7 to be turned on during the non-light emitting period, and the initial voltage signal VI is input to the light-emitting unit 40 or an input end of a light emitting device LED to reset its potential.

The light-emitting unit 40 comprises a light emitting device LED, an input end of the light emitting device LED is connected to the output end of the resetting transistor T7, and an output end of the light emitting device LED is connected to the second power signal ELVSS. Among them, the light emitting device LED may be, but not limited to, an OLED light emitting diode.

In one of the embodiments, the pixel circuit further comprises a driving unit 20 is serially connected to the light-emitting loop, and is configured to control a current flowing through the light-emitting loop.

The driving unit 20 comprises a driving transistor T1, and an input end of the driving transistor T1 is connected to the output end of the first light-emitting control transistor T5.

In one of the embodiments, the pixel circuit further comprises an initialization unit 50. An input end of the initialization unit 50 is connected to the output end of the resetting unit 30, and an output end of the initialization unit is connected to the control end of the driving unit 20, and is configured to initialize a potential of the control end of the driving unit 20 according to the first scan signal SCAN (N-1).

The initialization unit 50 comprises an initialization transistor T4, an input end of the initialization transistor T4 is connected to the output end of the resetting transistor T7, an output end of the initialization transistor T4 is connected to the control end of the driving transistor T1, and a control end of the initialization transistor T4 is connected to the first scan signal SCAN (N-1).

In one of the embodiments, the pixel circuit further comprises a writing unit 60 coupled to the input end or the output end of the driving unit 20, and is configured to write a data signal Vdata to the pixel circuit according to a second scan signal SCAN(N).

The writing unit 60 comprises a writing transistor T2, an input end of the writing transistor T2 is connected to the data signal Vdata, an output end of the writing transistor T2 is connected to the input end of the driving transistor T1 or the output end of the driving transistor T1, and a control end of the writing transistor T2 is connected to the second scan signal SCAN(N).

In one of the embodiments, the pixel circuit further comprises a clamping unit 80, an output end of the clamping unit 80 is connected to the control end of the driving unit 20, and an input end of the clamping unit 80 is connected to the input end of the driving unit 20 or the output end of the driving unit 20, and is configured to clamp the potential of the control end of the driving unit 20 to the potential of the input end of the driving unit 20 or the potential of the output end of the driving unit 20 according to the second scan signal SCAN(N).

The clamping unit 80 comprises a clamping transistor T3. An output end of the clamping transistor T3 is connected to the control end of the driving transistor T1. An input end of the clamping transistor T3 is connected to the input end of the driving transistor T1 or the output end of the driving transistor T1. A control end of the clamping transistor T3 is connected to the second scan signal SCAN(N).

In one of the embodiments, the pixel circuit further comprises a storage unit 70, a first end of the storage unit 70 is connected to the first power signal ELVDD, and a second end of the storage unit 70 is connected to the control end of the driving unit 20, and is configured to store the potential of the control end of the driving unit 20.

The storage unit 70 comprises a storage capacitor Cst, a first end of the storage capacitor Cst is connected to the first power signal ELVDD, and a second end of the storage capacitor Cst is connected to the control end of the driving transistor T1.

In one of the embodiments, the potential of the first power signal ELVDD is not less than the potential of the second power signal ELVSS.

In one of the embodiments, the first light-emitting control transistor T5, the second light-emitting control transistor T6, and the driving transistor T1 are all P-type low temperature polysilicon thin film transistors.

In one of the embodiments, the resetting transistor T7, the initialization transistor T4, the writing transistor T2, and the clamping transistor T3 are all N-type oxide thin film transistors. Among them, the oxide-type clamping transistor T3 has better low leakage characteristics, and can better prevent the gate leakage of the driving transistor T1.

When the resetting transistor T7 and the initialization transistor T4 are both N-type oxide thin film transistors, they can better prevent the anode leakage of the light emitting device LED. It is understandable that the oxide thin film transistor has low leakage characteristics. Therefore, during the off phase of the resetting transistor T7 and the initialization transistor T4, the anode of the light-emitting device LED can minimize the occurrence of its leakage.

Among them, in the embodiment of this application, only two scan signals of the same group type (that is, both high potential effective or low potential effective) and one light-emitting control signal EM (N) are used. The corresponding GOA circuit can reduce the design complexity. For example, reducing the use of the inverter at the output or the adjustment of the output phase, thereby simplifying the structure of the corresponding GOA circuit, and helping to achieve a narrow frame.

Figure 5:
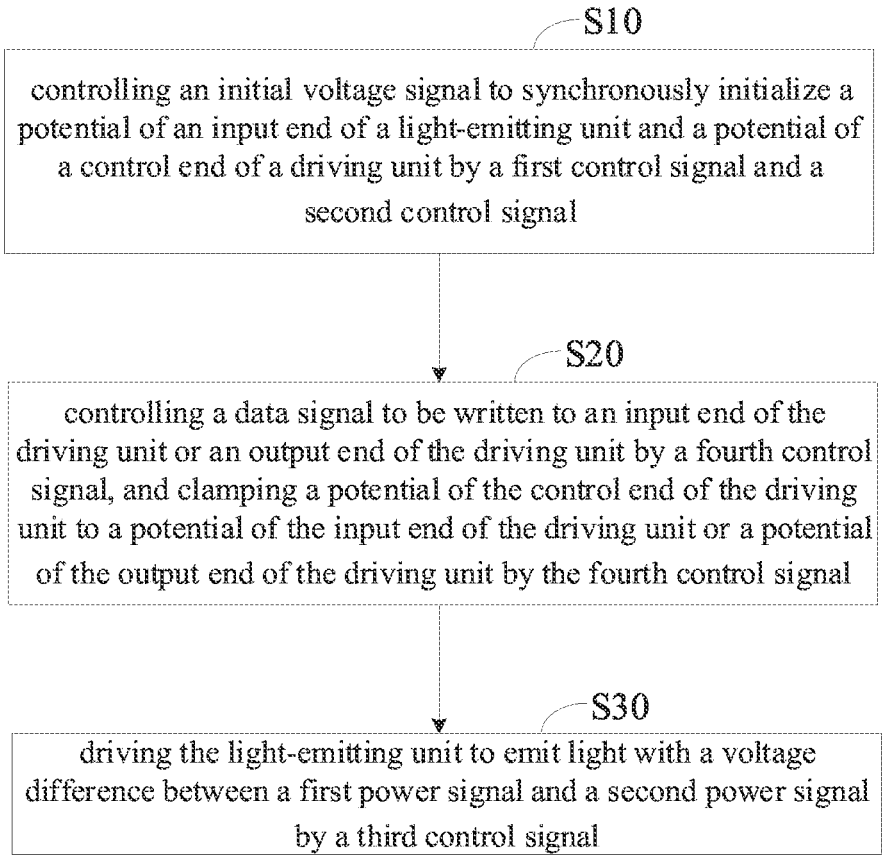
FIG. 5 is a schematic flowchart of the driving method provided by an embodiment of the application.

As shown in FIG. 5, in one of the embodiments, the present application provides a driving method of a pixel circuit, which comprises following steps of:

Step S10: controlling an initial voltage signal VI to synchronously initialize a potential of an input end of a light-emitting unit 40 and a potential of a control end of a driving unit 20 by a first control signal and a second control signal; step S20: controlling a data signal Vdata to be written to an input end of the driving unit 20 or an output end of the driving unit 20 by a fourth control signal, and clamping a potential of the control end of the driving unit 20 to a potential of the input end of the driving unit 20 or a potential of the output end of the driving unit 20 by the fourth control signal; and step S30: driving the light-emitting unit 40 to emit light with a voltage difference between a first power signal ELVDD and a second power signal ELVSS by a third control signal. The input end of the light-emitting unit 40 is controlled to reset by the light-emitting control signal EM (N) or the first scan signal SCAN (N-1), a longer reset time can be obtained, and the input end of the light-emitting unit 40 is not prone to leakage current, thereby improving the display effect of the pixel circuit in the dark state or low gray scale.

Figure 6:
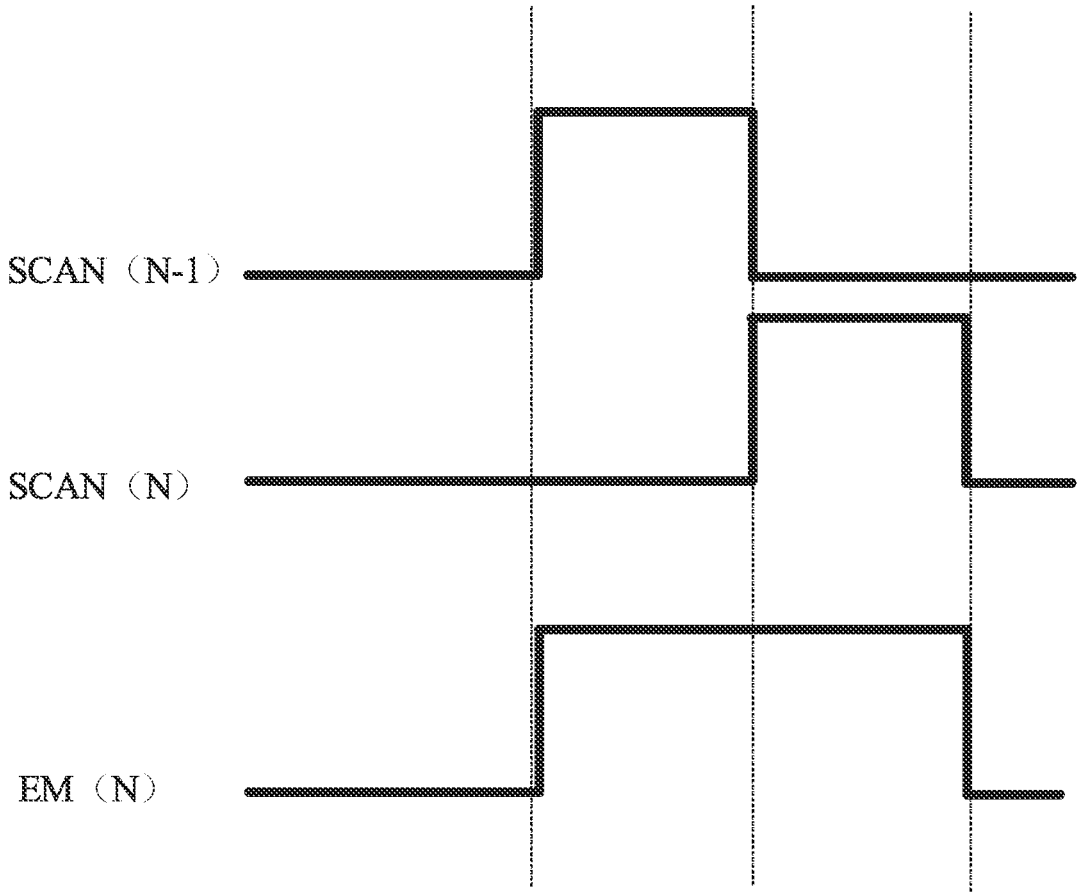
FIG. 6 is a timing diagram of the pixel circuit provided by an embodiment of the application.

Specifically, as shown in FIG. 6, when the light-emitting control signal EM(N) is at a high potential, the light-emitting control unit 10, that is, the first light-emitting control transistor T5 and the second light-emitting control transistor T6 are both in an off state, and the light emitting device LED does not emit light. When the first scan signal SCAN (N-1) is at a high potential and the second scan signal SCAN (N) is at a low potential, the resetting transistor T7 and the initialization transistor T4 are both in the on state to simultaneously initialize or reset the potential of the input end of the light emitting device LED and/or the potential of the gate of the driving transistor T1. When the first scan signal SCAN(N-1) is at a low potential and the second scan signal SCAN(N) is at a high potential, the second scan signal SCAN(N) controls the data signal Vdata to be written to the input end of the driving unit 20 or drive the output end of the unit 20, and the second scan signal SCAN(N) clamps the potential of the control end of the driving unit 20 to the potential of the input end of the driving unit 20 or the potential of the output end of the driving unit 20.

When the light-emitting control signal EM (N) is at a low potential, the first scan signal SCAN (N-1) is at a low potential, and the second scan signal SCAN (N) is at a low potential, and the light emitting device LED emits light.

Among them, the first scan signal SCAN(N-1) can be but is not limited to the N-1 level scan signal; the second scan signal SCAN(N) can be but is not limited to the N level scan signal, and N may be an integer not less than 2.

Among them, the light-emitting control signal EM (N) is displayed in the dark state or low gray scale, that is, the duration of its high potential is greater than the first scan signal SCAN (N-1) or the second scan signal SCAN (N) at the high potential. Therefore, when the light-emitting control signal EM(N) is used in this embodiment to control the input end of the light-emitting device LED, that is, the anode of the light-emitting diode to reset, the anode of the light-emitting diode can obtain a longer reset time. In addition, the number of input signals used by the pixel circuit in the corresponding embodiment can be reduced.

It should be noted that the input end of the corresponding thin film transistor mentioned in this application can be but not is limited to its drain, and can also be its source without affecting its function and effect. In the same way, the output end of the corresponding thin film transistor mentioned in this application can be but is not limited to its drain, and can also be its source without affecting its function and effect.

In one of the embodiments, the present application provides a display panel, which comprises any pixel circuit in the above embodiments.

Wherein, the first control signal may be, but is not limited to, the first scan signal SCAN (N-1), and may also be another square wave signal. The third control signal can be, but is not limited to, the light-emitting control signal EM (N), and can also be another square wave signal. The second control signal can be, but is not limited to, the first control signal or the third control signal, and can also be another square wave signal. The fourth control signal can be, but is not limited to, the second scan signal SCAN(N), and can also be other square wave signals.

It can be understood that for those of ordinary skill in the art, equivalent substitutions or changes can be made according to the technical solutions and inventive concepts of the present application, and all these changes or substitutions shall fall within the protection scope of the appended claims of the present application.

What is claimed is:

1. A pixel circuit, comprising:

a light-emitting device serially connected in a light-emitting loop between a first power signal and a second power signal;

a driving transistor serially connected in the light-emitting loop, and configured to control a current flowing through the light-emitting loop;

a resetting transistor, wherein one of a drain or a source of the resetting transistor is connected to an initial voltage signal, and another one of the drain or the source of the resetting transistor is connected to an anode of the light-emitting device;

an initialization transistor, wherein one of a drain or a source of the initialization transistor is connected to a gate of the driving transistor, and another one of the drain or the source of the initialization transistor is connected to the anode of the light-emitting device, wherein the resetting transistor and the initialization transistor are connected in series between the initial voltage signal and the gate of the driving transistor;

a first light-emitting control transistor, wherein one of a drain or a source of the first light-emitting control transistor is connected to the first power signal, and another one of the drain or the source of the first light-emitting control transistor is connected to one of a drain or a source of the driving transistor; and a second light-emitting control transistor, wherein one of a drain or a source of the second light-emitting control transistor is connected to another one of the drain or the source of the driving transistor, and another one of the drain or the source of the second light-emitting control transistor is connected to the anode of the light-emitting device, wherein a gate of the initialization transistor is connected to a first control signal, a gate of the resetting transistor is connected to a second control signal, the resetting transistor is configured to synchronously reset a potential of the anode of the light-emitting device and a potential of the gate of the driving transistor to a potential of the initial voltage signal according to the second control signal, a gate of the first light-emitting control transistor is connected to a third control signal, a gate of the second light-emitting control transistor is connected to the third control signal, and the second control signal is equal to the third control signal, and wherein a channel type of the resetting transistor is different from a channel type of the first light-emitting control transistor and a channel type of the second light-emitting control transistor.

2. The pixel circuit according to claim 1, further comprising:

a writing transistor, wherein one of a drain or a source of the writing transistor is connected to a data signal, another one of the drain or the source of the writing transistor is connected to one of the drain or the source of the driving transistor, and a gate of the writing transistor is connected to a fourth control signal.

3. The pixel circuit according to claim 2, further comprising:

a clamping transistor, wherein one of a drain or a source of the clamping transistor is connected to the gate of the driving transistor, another one of the drain or the source of the clamping transistor is connected to one of the drain or the source of the driving transistor, and a gate of the clamping transistor is connected to the fourth control signal.

4. The pixel circuit according to claim 3, further comprising:

a storage capacitor, wherein a first end of the storage capacitor is connected to the first power signal, and a second end of the storage capacitor is connected to the gate of the driving transistor.

5. The pixel circuit according to claim 4, wherein the resetting transistor is an oxide transistor, and the first light-emitting control transistor and the second light-emitting control transistor are both silicon transistors.

6. The pixel circuit according to claim 5, wherein the channel type of the resetting transistor and a channel type of the initialization transistor are same; and wherein the initialization transistor is an oxide transistor.

7. The pixel circuit according to claim 1, wherein a potential of the first power signal is greater than a potential of the second power signal.

8. A pixel circuit, comprising:

a light-emitting unit serially connected in a light-emitting loop between a first power signal and a second power signal;

a driving unit serially connected in the light-emitting loop, and is configured to control a current flowing through the light-emitting loop;

an initialization unit, wherein an input end of the initialization unit is connected to an input end of the light-emitting unit, an output end of the initialization unit is connected to a control end of the driving unit, and the initialization unit is configured to initialize a potential of the control end of the driving unit according to a first control signal;

a resetting unit connected to the input end of the light-emitting unit and configured to control a potential of the input end of the light-emitting unit and the potential of the control end of the driving unit to synchronously reset to a potential of an initial voltage signal according to a second control signal; and a light-emitting control unit serially connected in the light-emitting loop, wherein an output end of the light-emitting control unit is connected to the input end of the light-emitting unit, and the light-emitting control unit is configured to control the light-emitting loop on and off according to a third control signal, wherein the second control signal is equal to the third control signal.

9. The pixel circuit according to claim 8, further comprising:

a writing unit coupled to an input end or an output end of the driving unit and configured to write a data signal to the pixel circuit according to a fourth control signal.

10. The pixel circuit according to claim 9, further comprising:

a clamping unit, wherein an output end of the clamping unit is connected to the control end of the driving unit, an input end of the clamping unit is connected to the input end of the driving unit or the output end of the driving unit, and the clamping unit is configured to clamp the potential of the control end of the driving unit to a potential of the input end of the driving unit or a potential of the output end of the driving unit according to the fourth control signal.

11. The pixel circuit according to claim 10, further comprising:

a storage unit, wherein a first end of the storage unit is connected to the first power signal, a second end of the storage unit is connected to the control end of the driving unit, and the storage unit is configured to store the potential of the control end of the driving unit.

12. The pixel circuit according to claim 8, wherein a potential of the first power signal is greater than a potential of the second power signal.

13. A driving method of a pixel circuit, comprising following steps:

controlling an initial voltage signal to synchronously initialize a potential of an input end of a light-emitting unit and a potential of a control end of a driving unit by a first control signal and a second control signal;

controlling a data signal to be written to an input end of the driving unit or an output end of the driving unit by a fourth control signal, and clamping a potential of the control end of the driving unit to a potential of the input end of the driving unit or a potential of the output end of the driving unit by the fourth control signal; and driving the light-emitting unit to emit light with a voltage difference between a first power signal and a second power signal by a third control signal, wherein the second control signal is equal to the third control signal.

14. The driving method of the pixel circuit according to claim 13, wherein a potential of the first power signal is greater than a potential of the second power signal.

* * * * *